US007532952B2

(12) United States Patent
Curry et al.

(10) Patent No.: US 7,532,952 B2
(45) Date of Patent: May 12, 2009

(54) METHODS AND APPARATUS FOR PRESSURE CONTROL IN ELECTRONIC DEVICE MANUFACTURING SYSTEMS

(75) Inventors: Mark W. Curry, Morgan Hill, CA (US); Sebastien Raoux, Santa Clara, CA (US); Peter Porshnev, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/686,012

(22) Filed: Mar. 14, 2007

(65) Prior Publication Data

US 2007/0260351 A1 Nov. 8, 2007

Related U.S. Application Data

(60) Provisional application No. 60/890,609, filed on Feb. 19, 2007, provisional application No. 60/783,374, filed on Mar. 16, 2006, provisional application No. 60/783,370, filed on Mar. 16, 2006, provisional application No. 60/783,337, filed on Mar. 16, 2006.

(51) Int. Cl.
*G05D 11/00* (2006.01)

(52) U.S. Cl. ..... 700/282

(58) Field of Classification Search ..... 700/281, 700/282, 283, 285

See application file for complete search history.

(56) References Cited

U.S. PATENT DOCUMENTS

| | | | | |
|---|---|---|---|---|
| 3,918,915 | A | 11/1975 | Holler, Jr. | |
| 4,701,187 | A | 10/1987 | Choe et al. | |
| 4,720,807 | A * | 1/1988 | Ferran et al. | 700/282 |
| 4,820,319 | A | 4/1989 | Griffis | |
| 5,004,483 | A | 4/1991 | Eller et al. | |
| 5,759,237 | A | 6/1998 | Li et al. | |
| 5,976,222 | A | 11/1999 | Yang et al. | |
| 6,195,621 | B1 * | 2/2001 | Bottomfield | 702/183 |
| 6,227,347 | B1 | 5/2001 | Bryant et al. | |
| 6,316,045 | B1 * | 11/2001 | Bernard et al. | 427/8 |
| 6,419,455 | B1 * | 7/2002 | Rousseau et al. | 417/36 |
| 6,988,017 | B2 | 1/2006 | Pasadyn et al. | |
| 2003/0154044 | A1 | 8/2003 | Lundstedt et al. | |
| 2004/0144421 | A1 * | 7/2004 | Parce et al. | 137/14 |
| 2005/0087298 | A1 | 4/2005 | Tanaka et al. | |

(Continued)

FOREIGN PATENT DOCUMENTS

GB WO/2005/121912 * 12/2005

OTHER PUBLICATIONS

"Conductance Calculations"; Dec. 27, 2005; Kurt J. Lesker Company; pp. 1-3.*

(Continued)

*Primary Examiner*—Albert DeCady
*Assistant Examiner*—Chad Rapp
(74) *Attorney, Agent, or Firm*—Dugan & Dugan, PC

(57) ABSTRACT

In one aspect, improved methods and apparatus for pressure control in an electronic device manufacturing system are provided. The method includes acquiring information related to a current state of the electronic device manufacturing system, determining a desired value of a first parameter of the electronic device manufacturing system based on the acquired information and adjusting at least one parameter of a pump to obtain the desired value of the first parameter of the electronic device manufacturing system.

12 Claims, 9 Drawing Sheets

U.S. PATENT DOCUMENTS

| | | | | |
|---|---|---|---|---|
| 2005/0147509 | A1 | 7/2005 | Bailey et al. | |
| 2005/0160983 | A1* | 7/2005 | Sneh | 118/715 |
| 2005/0163622 | A1 | 7/2005 | Yamamoto et al. | |
| 2005/0209827 | A1 | 9/2005 | Kitchin | |
| 2005/0252884 | A1 | 11/2005 | Lam et al. | |
| 2005/0283321 | A1* | 12/2005 | Yue et al. | 702/30 |
| 2006/0175012 | A1* | 8/2006 | Lee | 156/345.29 |
| 2007/0012402 | A1* | 1/2007 | Sneh | 156/345.29 |
| 2007/0079758 | A1* | 4/2007 | Holland et al. | 118/715 |

OTHER PUBLICATIONS

"Vacuum system Overview: Pressure, Mass-flow and Conductance"; Mar. 15, 2004. pp.*

Mooney et al., "Pump Predictive Diagnostics [onlin]", Solid State Technology, Jul. 2005, pp. 1-3.

Office Action of U.S. Appl. No. 11/685,993 (9137) mailed Jun. 12, 2008.

International Search Report and Written Opinion of International Application No. PCT/US07/06495 (9137-PCT) mailed Jul. 15, 2008.

International Search Report and Written Opinion of International Application No. PCT/US07/06392 (9138-PCT) mailed Mar. 27, 2008.

Office Action of U.S. Appl. No. 11/686,005 (9139) mailed Jul. 31, 2008.

International Search Report and Written Opinion of International Application No. PCT/US07/06494 (9139-PCT) mailed Jun. 4, 2008.

* cited by examiner

METHODS AND APPARATUS FOR PRESSURE CONTROL IN ELECTRONIC DEVICE MANUFACTURING SYSTEMS

The present application claims priority to U.S. Provisional Application Ser. No. 60/783,374, filed Mar. 16, 2006 and entitled "METHODS AND APPARATUS FOR PRESSURE CONTROL IN ELECTRONIC DEVICE MANUFACTURING SYSTEMS", U.S. Provisional Patent Application Ser. No. 60/783,370, filed Mar. 16, 2006 and entitled "METHODS AND APPARATUS FOR IMPROVING OPERATION OF AN ELECTRONIC DEVICE MANUFACTURING SYSTEM", U.S. Provisional Application Ser. No. 60/890,609, filed Feb. 19, 2007 and entitled "METHODS AND APPARATUS FOR A HYBRID LIFE CYCLE INVENTORY FOR ELECTRONIC DEVICE MANUFACTURING", and U.S. Provisional Application Ser. No. 60/783,337, filed Mar. 16, 2006 and entitled "METHOD AND APPARATUS FOR IMPROVED OPERATION OF AN ABATEMENT SYSTEM", all of which are hereby incorporated herein by reference in their entirety for all purposes.

CROSS-REFERENCE TO RELATED APPLICATIONS

The present application is related to the following commonly-assigned, co-pending U.S. patent applications, each of which is hereby incorporated herein by reference in its entirety for all purposes:

U.S. patent application Ser. No. 11/685,993, filed Mar. 14, 2007, and titled "METHODS AND APPARATUS FOR IMPROVING OPERATION OF AN ELECTRONIC DEVICE MANUFACTURING SYSTEM"; and U.S. patent application Ser. No. 11/686,005, filed Mar. 14, 2007, and titled "METHOD AND APPARATUS FOR IMPROVED OPERATION OF AN ABATEMENT SYSTEM".

FIELD OF THE INVENTION

The present invention relates generally to electronic device manufacturing systems and is more particularly concerned with improved methods and apparatus for pressure control in electronic device manufacturing systems.

BACKGROUND OF THE INVENTION

Electronic device manufacturing tools conventionally employ process chambers or other suitable apparatus adapted to perform processes (e.g., chemical vapor deposition, epitaxial silicon growth, etch, etc.) for manufacturing electronic devices. Such processes may produce effluents having undesirable chemicals as by-products of the processes. Pumps (e.g., vacuum pumps) may be used to remove the effluents from process chambers and to provide a vacuum to the process chambers.

To regulate the pressure within a process chamber, one or more additional components may be coupled to the process chamber (e.g., throttle valves, gate valves, etc.). These components also regulate the flow of the effluent (e.g., fluid, gas, emulsions, etc.) exiting the processing chamber, and may undesirably affect the processes performed and/or the other components of a manufacturing system. Accordingly, there is a need for improved methods and apparatus for pressure control in electronic device manufacturing systems.

SUMMARY OF THE INVENTION

In a first aspect of the present invention, a first method of regulating pressure in an electronic device manufacturing system is provided. Embodiments of the method include (1) acquiring information related to a current state of the electronic device manufacturing system, (2) determining a desired value of a first parameter of the electronic device manufacturing system based on the acquired information, and (3) adjusting at least one parameter of a pump to obtain the desired value of the first parameter of the electronic device manufacturing system.

In another aspect of the present invention, a method of providing maintenance in an electronic device manufacturing system including an electronic device manufacturing tool and a pump is provided. Embodiments of the method include (1) acquiring information related to a current state of the electronic device manufacturing tool and pump, (2) processing the information related to the current state of the electronic device manufacturing tool and pump, and (3) determining predictive maintenance requirements for the pump based on the processed information.

In a third aspect of the present invention, a method of equilibrating corresponding vacuum line parameters in an electronic device manufacturing system including a pump is provided. Embodiments of the method include (1) acquiring information related to a parameter of a first vacuum line and information related to a parameter of a second vacuum line, (2) comparing the information related to the parameter of the first vacuum line with the information related to the parameter of the second vacuum line, and (3) adjusting at least one parameter of the pump such that corresponding parameters of the first and second vacuum lines are equilibrated.

In a fourth aspect of the present invention, an electronic device manufacturing system is provided which includes (1) an electronic device manufacturing tool having a process chamber, (2) a pump coupled to the process chamber, and (3) an interface communicatively coupled to the electronic device manufacturing tool and the pump adapted to receive current state parameter information from and adapted to adjust operation of the electronic device manufacturing tool and pump so as to obtain a desired value of a parameter of the electronic device manufacturing tool or the pump.

Other features and aspects of the present invention will become more fully apparent from the following detailed description, and appended claims and the accompanying drawings.

DETAILED DESCRIPTION

The present invention provides methods and systems for adjusting parameters (e.g., pump speed, purge pressure, etc.) to control a pressure in a process chamber of an electronic device manufacturing system. Such methods and apparatus may be employed to eliminate and/or optimize the use of other components typically employed to regulate chamber pressure. For example, a throttle valve typically employed to regulate chamber pressure may be optimally positioned to minimize potential undesirable affects that the throttle valve may have on the parameters of a process chamber. In addition, the present invention may be employed to better extend and/or predict the maintenance requirements of components, such as a pump, of the electronic device manufacturing system.

The present invention also provides methods and systems for reducing chamber to chamber variations by controlling a parameter, such as the pressure provided by a pump, so as to reduce the affects of such variations on process performance. For example, a throttle valve within more than one chamber may be opened to approximately the same position and thus the flow (e.g., laminar, turbulent, etc.) of effluent may be equilibrated between the chambers.

In at least one exemplary embodiment, the amount of vacuum force provided to a chamber is controlled by the speed of a pump. The amount of vacuum force applied is related to parameters such as the shapes of the forelines, properties of the effluents, and other like parameters that are employed. The present invention provides for the adjustment of pump speed to compensate for these and other parameters. In this manner, the pressure in the chamber may be controlled by the pump. In some embodiments, the throttle valve position may be set to a maximum open position. This may allow for a reduction of particle accumulation in a process chamber. In at least one alternative embodiment, a throttle valve may be eliminated from the system.

Figure 1:
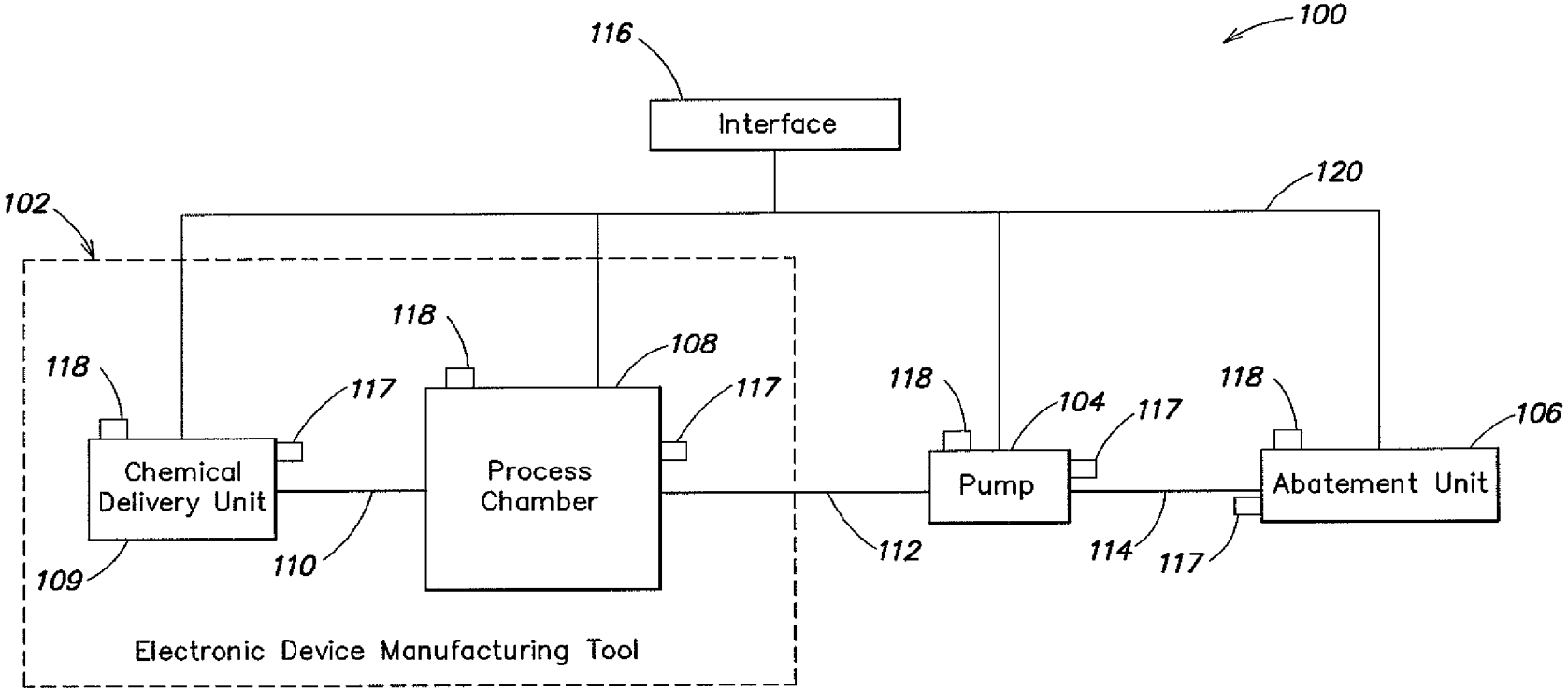
FIG. 1 is a schematic block diagram depicting an electronic device manufacturing system in accordance with the present invention.

FIG. 1 is a schematic block diagram depicting an electronic device manufacturing system 100 in accordance with an embodiment of the present invention. The electronic device manufacturing system 100 may include an electronic device manufacturing tool 102 coupled to a pump 104, and an abatement unit 106 coupled downstream from the pump 104. The electronic device manufacturing tool 102 may include a process chamber 108 adapted to perform one or more processes (deposition, etching, etc.) on a substrate and a chemical delivery unit 109 (e.g., gas panel, a slurry delivery unit, a liquid precursor delivery system, etc.) adapted to deliver chemicals to the process chamber 108 via a fluid line 110. The chemical delivery unit 109 may provide chemical precursors (e.g., $SiH_4$, $NF_3$, $CF_4$, $BCl_3$, etc.) employed by the process chamber 108 in performing one or more processes via the fluid line 110.

The processes performed in the process chamber 108 may occur at a pressure below ambient pressure (e.g., one atmosphere (atm), etc.). For example, some processes may be performed at pressures of about 8 to 700 milli-torr (mTorr), although other pressures may be used. In other processes, such as in some deposition procedures, pressures below 8 Torr may be used. The process chamber 108 of the electronic device manufacturing tool 102 may be coupled to the pump 104 via a vacuum line 112. To generate sub-atmospheric pressures within the process chamber 108, the pump 104 may remove effluent (e.g., gas, plasma, etc.) from the process chamber 108 by application of a vacuum. In particular, the effluent may be drawn from the process chamber 108 by the vacuum line 112 towards the pump 104 by the vacuum force created by the pump 104. In one or more embodiments, the pump 104 may include rotatable components such as impellers (e.g., lobes, blades, etc., not shown) and the vacuum force may be generated by the rotation of the impellers included in the pump 104. The vacuum force and consequent pressure reduction generated by action of the pump 104 may be proportional to the rotation speed of the impellers. Similarly, the amount and/or rate at which the effluent may be removed from the process chamber 108 may be proportional to the vacuum force, and thereby to the speed at which the impellers of the pump 104 rotate. The impeller rotation speed may vary from about 200 to about 18,000 RPM although other rotation speeds may be used.

The pump 104 may be coupled to the abatement unit 106 via a conduit 114. The abatement unit 106 may treat effluents of the electronic device manufacturing tool 102 so as to remove contaminants, pollutants and/or hazardous chemicals from the effluents. The abatement unit 106 may comprise, for example, a controlled decomposition oxidation (CDO), a water scrubber, an absorption based passive resin, a combustion system, etc. An exemplary abatement unit that may be used in the context of the present invention is the Marathon system available from Metron Technology, Inc. of San Jose, Calif. Other abatement units may be used.

An electronic interface 116 may be coupled to and receive signals from the process chamber 108, the chemical delivery unit 109, the pump 104, and the abatement unit 106 via signal lines 120. The interface 116 may include analog and/or digital electronic components, such as a microprocessor, I/O ports, modem, etc., adapted to process, transmit and receive information to/from other portions of the electronic device manufacturing system 100. The interface 116 may also comprise a host computer, mainframe computer, server or other computer system. The interface 116 may receive information related to processes occurring in other components of the system 100, such as the process chamber 108 via signal lines 120. The information related to the processes may include parameters such as process step time, pressure, fluid flows, etc.

In one or more embodiments, the interface 116 may also receive information from one or more databases containing information concerning known behaviors of the process-related parameters. As described in previously-incorporated U.S. patent application Ser. No. 11/685,993, the database may be populated with information derived from an instrumented reference system (not shown) having a similar design to the electronic device manufacturing system 100 in which system parameters may be precisely measured over time. The parameter measurements taken by the reference system may be used to derive functions (e.g., best-fit curves, normal distribution equations, etc.) describing the behavior of one or more of the parameters over time, or as a function of one or more other parameters. These functions can be described using constants that can then be organized in a database accessible by the interface 116. The interface 116 may use the information in the database to determine desired and/or optimal values at which to adjust actual parameters of the electronic device manufacturing system 100.

The interface 116 may also provide information to portions of the electronic device manufacturing system 100 via signal lines 120. For example, the interface 116 may provide information to the pump 104 (e.g., based on information received from other parts of the system 100, such as the process chamber 108). Such information may be employed to adjust pump parameters, such as the vacuum force applied by the pump 104, in order to regulate pressure and other physical and/or chemical parameters in the electronic device manufacturing system 100. In one or more embodiments, the interface 116 may provide information to the pump 104 to modify the pressure in the process chamber 108 to a desired level.

Sensors 117 and/or controllers 118 may be coupled to the electronic device manufacturing tool 102 (e.g., to the process chamber 108, and the chemical delivery unit 109), the pump 104 and the abatement unit 106. Sensors 117 and/or controllers 118 may generate signals that provide information (e.g., status, operational, etc.) concerning the various components (e.g., electronic manufacturing tool 102, pump 104, abatement unit 106) of the electronic device manufacturing system 100 to the interface 116 along signal lines 120. The information may be related to parameters such as, for example, the pressure within the process chamber 108 of the electronic device manufacturing tool 102, the speed of the pump 104, and the presence of certain types of gases in the abatement unit 106. Sensor types may include pressure gauges, timers for measuring step times, power meters, etc.

Information may also be provided to the interface 116 by controllers 118 (e.g., rack-mounts, workstations, controller boards, embedded processors, etc.) adapted to control, and/or receive information from the electronic device manufacturing tool 102, pump 104 and abatement unit 106 (e.g., via sensors 117). A controller 118 may be implemented as a plurality of controllers. For example, the process chamber 108 may be coupled to a first controller 118 and the chemical delivery unit 109 may be coupled to a second controller 118. Alternatively, a single controller 118 and/or a network of controllers 118 may be employed to control the electronic device manufacturing tool 102 and/or processing chamber 108 and chemical delivery unit 109. The information provided by the controllers 118 may be related to control signals provided by the controller 118 to the components of the electronic device manufacturing system 100. For example, a controller 118 coupled to the process chamber 108 may provide a signal to the process chambers 108 to begin a step in a process recipe. Such information may be provided to the interface 116.

Within the electronic manufacturing tool 102, the pressure in the process chamber 108 may be affected by additional parameters aside from the effluent removal rate and fluid supply rate such as, for example, the fluid conductivity of the vacuum line 112. The vacuum line 112 may have a cross sectional dimension that is restrictive and/or other constrictive or restrictive features. The fluid conductivity of the vacuum line 112 may be inversely proportional to the length of the vacuum line 112, and thus, the pressure in the process chamber 108 may be higher due to a longer vacuum line 112. Such differences may be compensated for by adjusting the pump speed. For example, in cases in which the vacuum line 112 is relatively long, the pump speed of the pump 104 may be increased in compensation. Further details of such pressure regulation are discussed below with reference to FIGS. 6-7.

Figure 2:
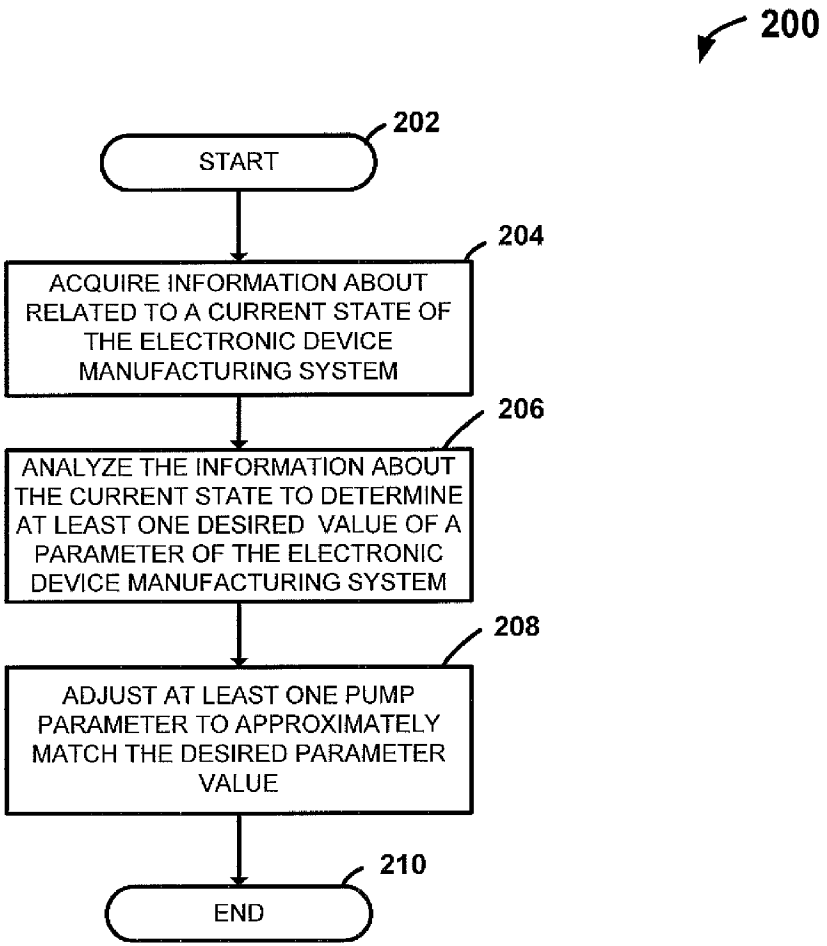
FIG. 2 is a flowchart of a method of regulating pressure in a process chamber by adjusting pump parameters in accordance with the present invention.

FIG. 2 is a flowchart of an exemplary embodiment of a method of regulating an operational parameter within an electronic device manufacturing system by adjusting pump parameters in accordance with the present invention. The method 200 begins with step 202. In step 204 the interface 116 acquires information regarding a current state of the electronic device manufacturing system 100. The information regarding the current state of the electronic device manufacturing system 100 may include the types of processes being performed in the process chamber, and measurements of current operational parameters taken by one or more sensors 117. The operational parameters may include, for example, the current pressure in the process chamber 108, fluid flow rates from the chemical delivery unit 109, effluent flow rates in the conduit 114, and the like. In step 206, the information regarding the current state of the electronic device manufacturing system 100 may be analyzed to determine desired parameter values. The parameters for which desired values are determined may be the same or different from the operational parameters measured. More specifically, the current operational parameters, including the chamber pressure, gas flow rates, etc., may be employed in generating a 'predictive solution' of fluid flow exiting from the process chamber 108 which may be analyzed to determine desired parameter values. The desired parameter values may be obtained from a local or remote reference database (not shown) that may include data concerning functional relationships between the various parameters.

As described in previously incorporated U.S. patent application Ser. No. 11/686,005, filed concurrently, the data included in the reference database may be derived from a reference system (not shown) that largely corresponds to the electronic device manufacturing system 100, but in which dedicated testing equipment can be employed to gather large amounts of data over time concerning physical and/or chemical parameters such as pressure, gas flows, gas content, etc. This data may be analyzed to determine the functional relationships; the functional relationships may be represented using parameters (e.g., constants that may be 'plugged into' function equations) which may then be incorporated in the reference database. Desired parameter values may be then obtained from measured values based on such functional relationships.

Referring again to FIG. 2, once desired parameter values have been determined, in step 208 a parameter of the pump 104 may be adjusted to approximately match the desired parameter value determined in step 206. For example, the pump 104 speed may be adjusted to produce the desired parameter value (e.g., pressure in the process chamber 208). The method 200 ends in step 210.

Figure 3:
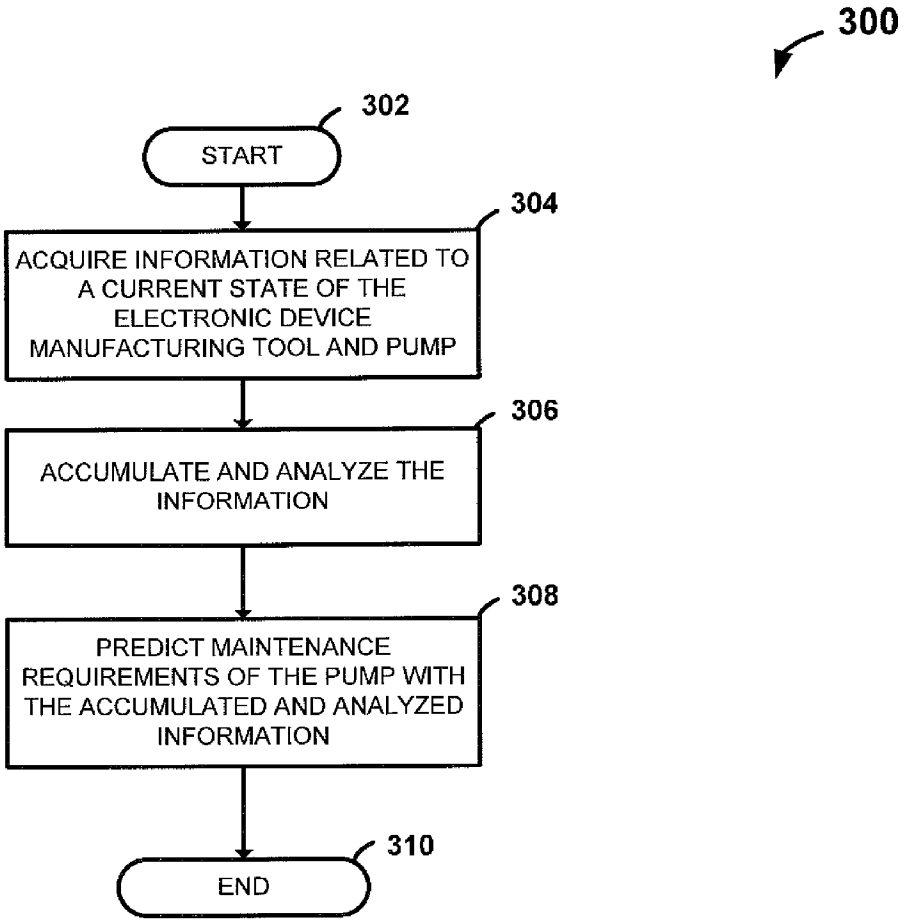
FIG. 3 is a flowchart of a method of optimizing the preventive maintenance of a pump using operational data of an electronic device manufacturing tool and the pump in accordance with the present invention.

FIG. 3 is a flowchart of an example embodiment of a method of optimizing preventive maintenance of the pump 104 in accordance with the present invention. The method 300 begins with step 302. In step 304, information is acquired related to a current state of the electronic device manufacturing tool 102 and the pump 104. The information may include a series of data taken over a period of time including pump speed data, pump purge pressure data, type(s) of fluid flowing into the process chamber 108, integrated fluid flow rate data, etc. The acquisition of the information may be performed using sensors 117 and controllers 118 of the electronic device manufacturing system 100 and/or using a reference system (not shown). The sensors 117 and/or controllers 118 may provide the information to the interface 116 or another suitable apparatus.

In step 306, the information related to the electronic device manufacturing tool 102 and the pump 104 may be accumulated and analyzed using the interface 116 or another suitable apparatus. The analysis of the information may include accumulating the number of pump rotations, the time between failures, the pump purge rate, etc. Such analysis may be employed to correlate the accumulated information related to one or more parameters with the maintenance and/or failures of the pump. The analysis may include a design of experiments (DOE) methodology. In at least one embodiment, sensors 117 can be employed to measure changes in the performance or output of pump parameters. For example, sensors 117, such as an acoustic microphone, may be placed on/near a bearing to "hear" when the bearing becomes worn, or unbalanced. The changes in performance and/or output may be correlated with specific operating parameters such as motor current, cooling water temperature, exhaust pressure, motor temperature, pump body temperature, etc. The design of experiments method may be used to establish the "normal" operating range, and what signifies an excursion out of the normal operating range.

In step 308, the maintenance requirements of the pump 104 may be predicted. The prediction of the maintenance may be based on the accumulation and analysis of the information in step 306. The prediction may be made by communicating the result of the analysis performed during step 306 to an agent (e.g., engineer, workstation, etc.) that is enabled to evaluate the prediction. For example, the accumulated and analyzed information of step 306 may be further analyzed after being communicated to an agent so as to make the prediction. The predicted maintenance requirements of the pump 104 may be employed to schedule maintenance of the pump 104. In addition, the predicted downtime of the pump 104 may be employed to optimally schedule the maintenance of the pumps so as to prevent unexpected failures (e.g., catastrophic, etc.). Subsequent to step 308, the method 300 ends in step 310.

Figure 4:
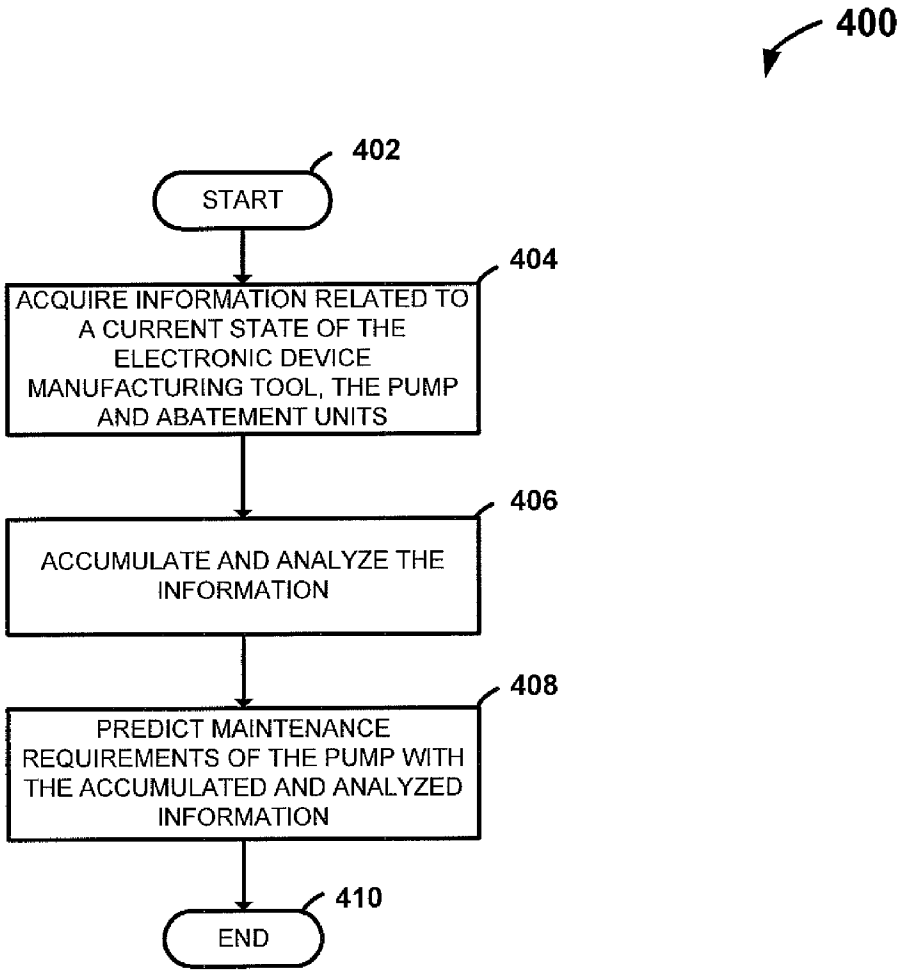
FIG. 4 is a flowchart of a method of optimizing the preventive maintenance of a pump using operational data of the electronic device manufacturing tool, pump and abatement unit in accordance with the present invention.

FIG. 4 is a flowchart of an example embodiment of a method of optimizing the preventive maintenance of the pump 104 using operational data of the electronic device manufacturing tool 102, pump 104 and abatement unit 106 in accordance with the present invention. The method 400 is similar to method 300 with the addition of acquiring information from the abatement unit 106 to predict the preventive maintenance schedule of the pump 104. The method 400 begins with step 402.

In step 404, information related to the electronic device manufacturing tool 102, the pump 104, and the abatement unit 106 is acquired. In addition to the information discussed with reference to FIG. 3, the information acquired in step 404 may include information related to the abatement unit 106. The abatement unit 106 may provide information related to the abatement process employed to attenuate the effluent produced by the electronic device manufacturing tool 102. Such information may be related to a temperature, content and pressure of effluent gases in the abatement unit, for example.

In a manner similar to step 306, in step 406 the information acquired in step 404 may be accumulated and analyzed. The accumulation and analysis of step 404 may include the methods discussed in step 304. In step 408, in a manner similar to step 308, the accumulated and analyzed information of step 406 may be employed to predict maintenance requirements of the pump 104. Subsequent to step 408, the method 400 ends in step 410.

Figure 5:
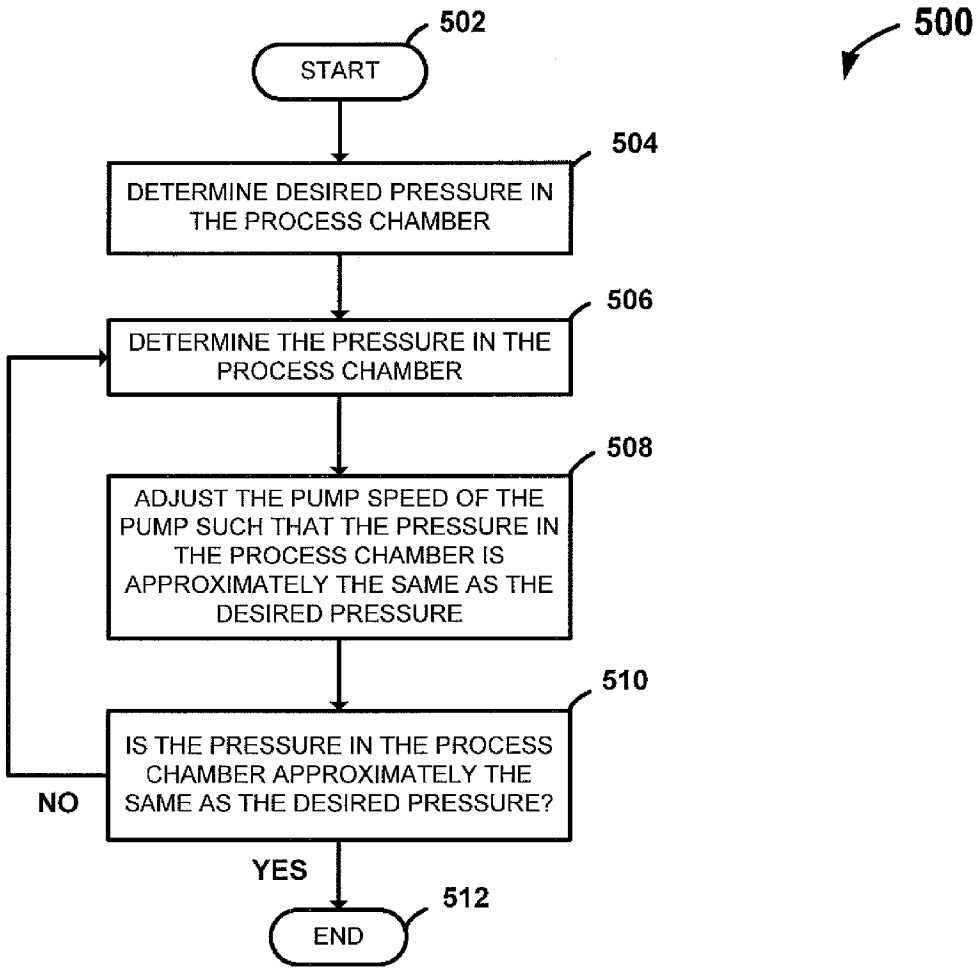
FIG. 5 is a flowchart of a method of controlling the pressure in a process chamber by adjusting at least one parameter of a pump in accordance with the present invention.

FIG. 5 is a flowchart of an example embodiment of a method of controlling the pressure in the process chamber 108 of an electronic device manufacturing tool 102 by adjusting at least one parameter of the pump 104 in accordance with the present invention. The method 500 begins with step 502. In step 504, a desired pressure in the process chamber 108 may be determined. The desired pressure may be determined from the current state of one or more parameters of the electronic device manufacturing system 100 using a reference database (as discussed above with respect to FIG. 2), a process recipe, etc. Relevant parameters may include a ramp rate of the pressure of the pump 104, time to ramp, the length of the vacuum line and the like. Additionally or alternatively, predictive solutions may be employed to determine the desired pressure. For example, a predictive solution that evaluates parameters (e.g., pipe length, fluid flow rates, etc.) may be employed to predict the effluent from the process chamber 108. By employing a prediction of parameters of the effluent, the desired pressure may be determined so as to account for changes in parameter values that may occur in the future. In step 506, the pressure in the process chamber 108 may be determined. Step 506 may include acquiring information from sensors 117 and/or controllers in the electronic device manufacturing tool 102 (e.g., process chamber 108).

In step 508, the speed of the pump 104 may be adjusted such that the pressure in the process chamber 108 reaches the same or approximately the same value as the desired pressure determined in step 504. The pressure in the process chamber 108 may be modified via the changes in vacuum force applied by the pump 104. Additional methods and apparatus of modifying the pressure in the process chamber 108 may be employed in conjunction with the adjustments to the speed of the pump 104 in step 508. For example, the process chamber 108 may be coupled to one or more additional pressure regulation devices such as a throttle valve, additional vacuum pumps, etc. The pressure regulation device(s) may, in conjunction with the pump 104, modify the pressure in the process chamber 108 to reach the same or approximately the same value as the desired pressure. In step 510, it is verified whether the adjustment to the pump speed has sufficiently achieved the desired pressure in the process chamber 208. If the pressure in the process chamber 108 is not approximately the same as the desired pressure, then the method 500 returns to step 506. If the pressure in the process chamber 108 is approximately the same as the desired pressure, the method 500 may proceed to step 512, in which the method 500 ends.

Figure 6:
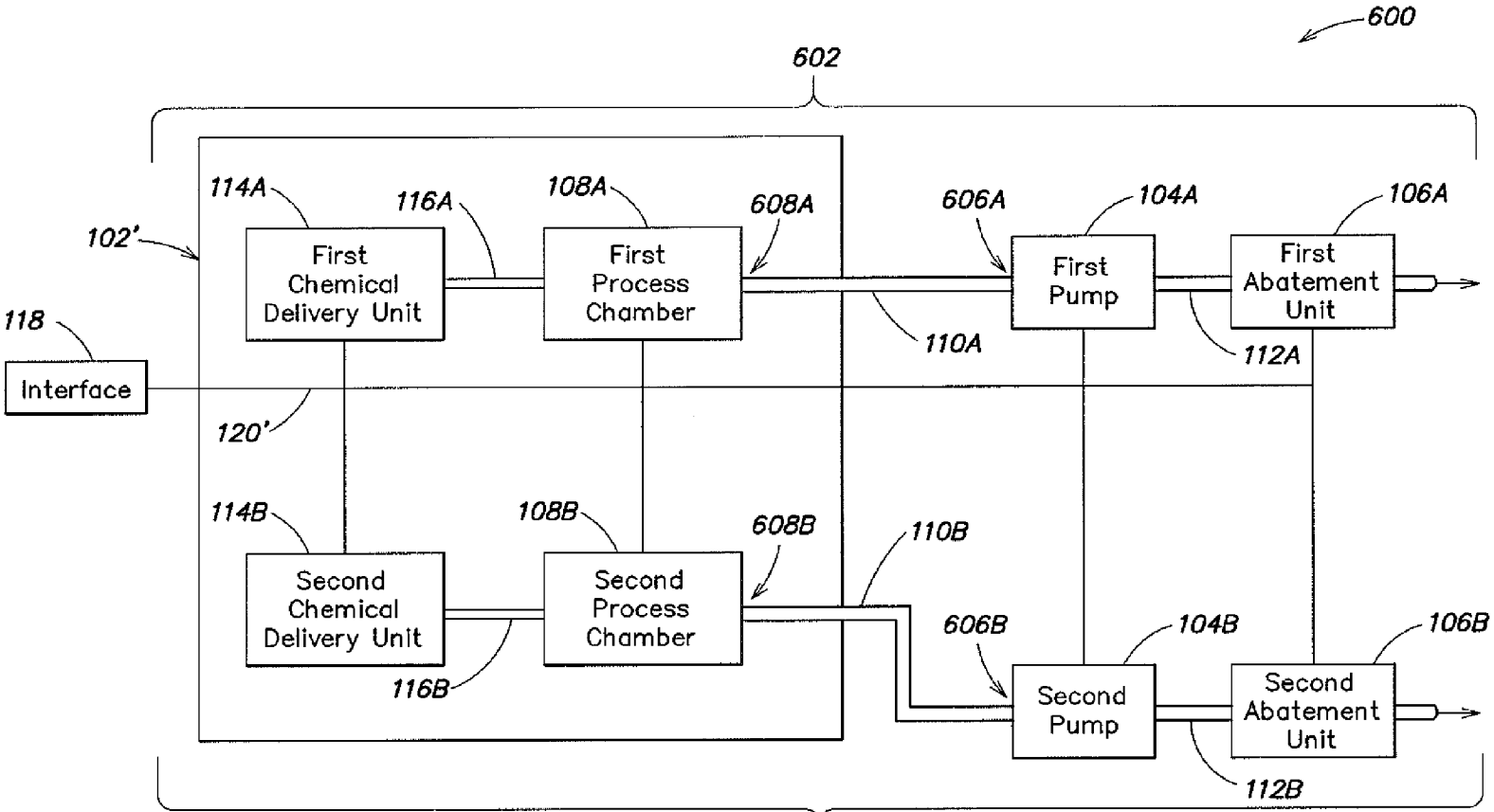
FIG. 6 is a schematic block diagram including a first and second set of process chambers, vacuum lines, pumps, conduits and abatement units in which at least one pair of like parameters of the first set and second set are optimally matched in accordance with the present invention.

FIG. 6 is a schematic block diagram of an example embodiment of an electronic device manufacturing system 600 including first and second sets of process chambers, vacuum lines, pumps, conduits and abatement units wherein at least one pair of like parameters of the first set and second set are optimally matched in accordance with the present invention. As depicted in FIG. 6, the dual electronic device manufacturing system 600 includes a dual electronic device manufacturing tool 102'. The electronic device manufacturing system 600 also includes a first set of devices 602 that may include a first pump 104A, a first abatement unit 106A, a first process chamber 108A, a first vacuum line 110A, a first conduit 112A, a first chemical delivery unit 114A, and a first fluid line 116A. The electronic device manufacturing system 600 may also include a second set of devices 604 that may include a second pump 104B, a second abatement unit 106B, a second process chamber 108B, a second vacuum line 110B, a second conduit 112B, a second chemical delivery unit 114B, and a second fluid line 116B.

The first set of devices 602 and the second set of devices 604 may comprise similar types of components, having similar operational parameters which may be directly compared. For example, the first pump 104A may have a first pump speed. The second pump 104B may have a second pump speed. Thus, in this embodiment, the first and second pump speeds are similar, comparable parameters.

With regards to the first set of devices 602, the first pump 104A may be coupled to the first process chamber 108A via the first vacuum line 110A, the first chemical delivery unit 114A may be coupled to the first process chamber 108A via the first fluid line 116A, and the first abatement unit 106A may be coupled to the first pump 104A via the first conduit 112A. Analogously, in the second set of devices 604, the second pump 104B may be coupled to the second process chamber 108B via the second vacuum line 110B, the second chemical delivery unit 114B may be coupled to the second process chamber 108B via the second fluid line 116B, and the second abatement unit 106B may be coupled to the second pump 104B via the second conduit 112B.

The first vacuum line 110A and the second vacuum line 110B may have different parameters that affect a fluid conductivity of the vacuum lines 110A and 110B. Parameters that may affect the conductivity of the vacuum lines 110A and 110B may include the width, shape, material, etc. of the vacuum lines 110A and 110B. For example, as depicted in FIG. 6, the second vacuum line 110B may have a different shape (e.g., longer, bent, etc.) than the first vacuum line 110A. A pressure differential between the vacuum lines 110A and 110B may be proportional to the difference in length of the vacuum lines 110A and 110B. More specifically, the pressure in the vacuum lines 110A and 110B may be approximately equal near the locations 606A and 606B and may be different at locations 608A and 608B. For example, the pressure at location 608A may be lower than the pressure at location 608B. However, by employing the pumps 104A and 104B to compensate for the pressure differential, the pressures at location 608A and 608B may be equilibrated.

Figure 7:
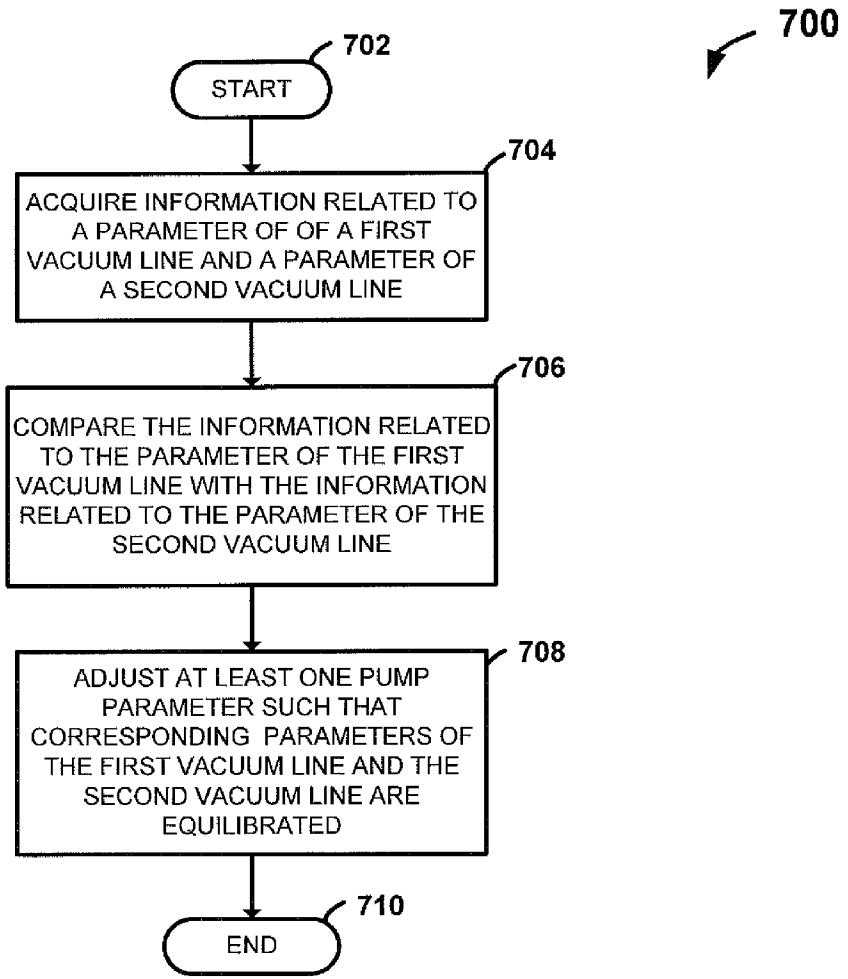
FIG. 7 is a flowchart of a method of adjusting at least one parameter of a first and second pump so that the at least one parameter of a first and second vacuum line may be equilibrated in accordance with the present invention.

FIG. 7 is a flowchart of a method of adjusting at least one parameter of the first and second pump in the electronic device manufacturing system 600 so that the at least one parameter of the first and second vacuum line may be equilibrated in accordance with the present invention.

The method 700 begins with step 702. In step 704, information related to the parameters of a first vacuum line 110A and a second vacuum line 110B may be acquired. The information may be related to the pressure, chemical composition, viscosity, etc., of the effluent in the first vacuum line 110A and the second vacuum line 110B. The information may be provided by sensors and/or controllers (not shown) coupled to the first and second vacuum lines 110A, 110B.

In step 706, the parameter information of vacuum lines 110A and 110B may be compared. For example, pressures at locations 608A and 608B may be compared. In step 708, at least one pump parameter may be adjusted such that at least one pair of corresponding parameters of the first vacuum line 110A and the second vacuum line 110B may be equilibrated (e.g., the pressure at corresponding points 608A, 608B along vacuum lines 110A, 110B). The method 700 ends in step 710.

Figure 8:
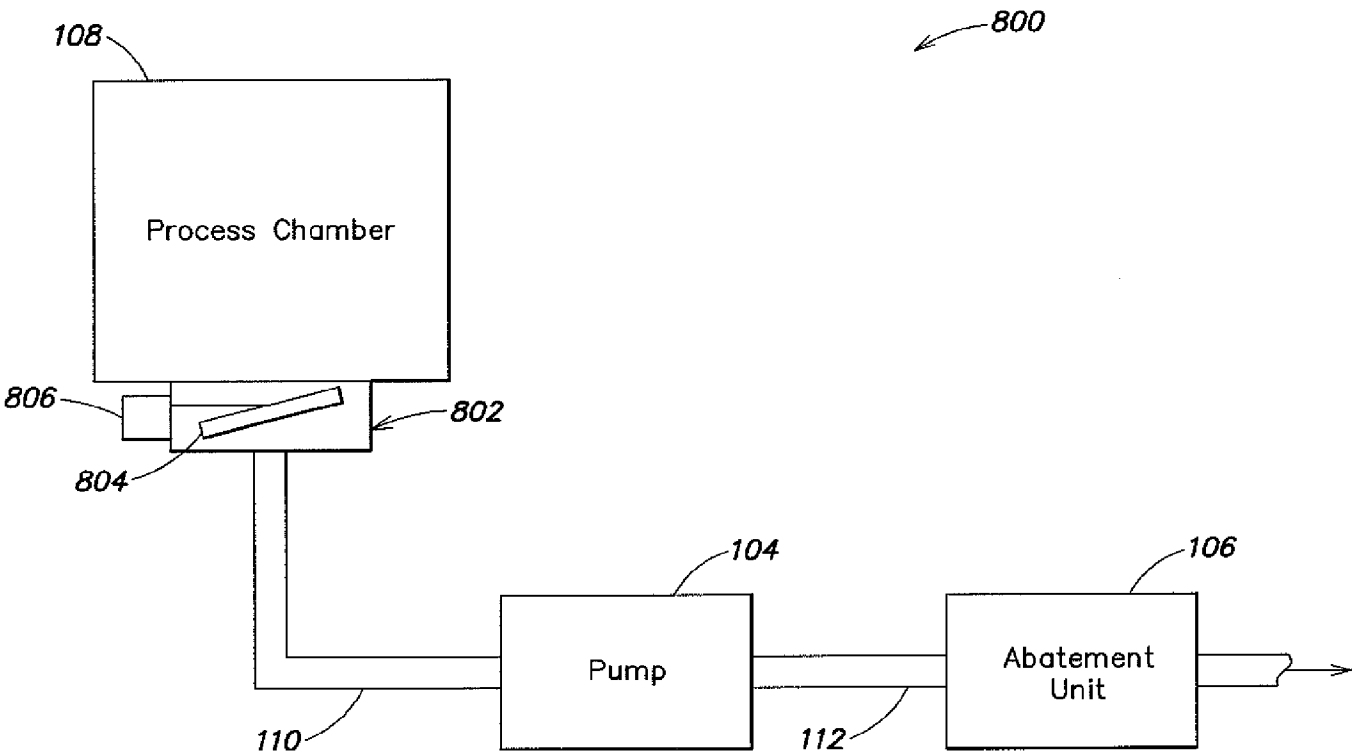
FIG. 8 is a schematic block diagram depicting a throttle valve coupled to a process chamber wherein the affect of the throttle valve on the parameters of the process chamber may be minimized in accordance with the present invention.

FIG. 8 is a schematic block diagram depicting an apparatus 800 having a throttle valve 802 coupled to a process chamber 108 wherein the affect of the throttle valve on the parameters of the process chamber may be minimized in accordance with the present invention. The apparatus 800 may include a pump 104 coupled to the vacuum line 110 via a throttle valve 802. The throttle valve 802 may include a vane 804 rotatively coupled to a motor 806. The motor 806 may also be coupled to the throttle valve 802. Similar to the apparatus 100 described with reference to FIG. 1, the vacuum line 110 may be coupled to the pump 104, and the pump 104 may be coupled to the abatement unit 106 via the conduit 112.

The vane 804 of the throttle valve 802 may be employed to modify the pressure in the process chamber 108. As described with reference to FIG. 1, the chemical delivery unit 114 may supply precursor chemicals to the process chamber 108, and the pump 104 may remove effluent from the process chamber 108. The vane 804 may regulate the removal of the effluent so as to adjust the pressure in the process chamber 108. For example, in an embodiment, the vane 804 may comprise a disk that may be rotated about an axis by the motor 806. The vane 804 may rotate from a fully open position to a fully closed position and any position therebetween. The fully or partially closed position may sufficiently restrict the flow of effluent from the process chamber 108 so as to increase the pressure in the process chamber 108. A fully open position may not increase the pressure in the process chamber, although the presence of the vane 804 in the path of the effluent may have a nominal effect on the flow of the effluent leaving the process chamber 108, thereby possibly affecting parameters of the processing chamber 108.

The pump 104 may be employed to reduce the use of the throttle valve 802 in regulating the pressure in the process chamber 108. As described with reference to FIG. 5, the pump 104 may be employed to regulate the pressure in the process chamber 108. By employing such a method in conjunction with the throttle valve 802, the vane 804 may be optimally positioned. For example, it may be desirable to reduce a portion of the effluent being deflected back into the chamber by optimally positioning the vane 804. Thus, by employing the pump 104 in conjunction with the throttle valve 802 to control the pressure in the process chamber 108, the vane 804 may be optimally positioned to reduce the amount of effluent being reflected back into the process chamber 108.

Figure 9:
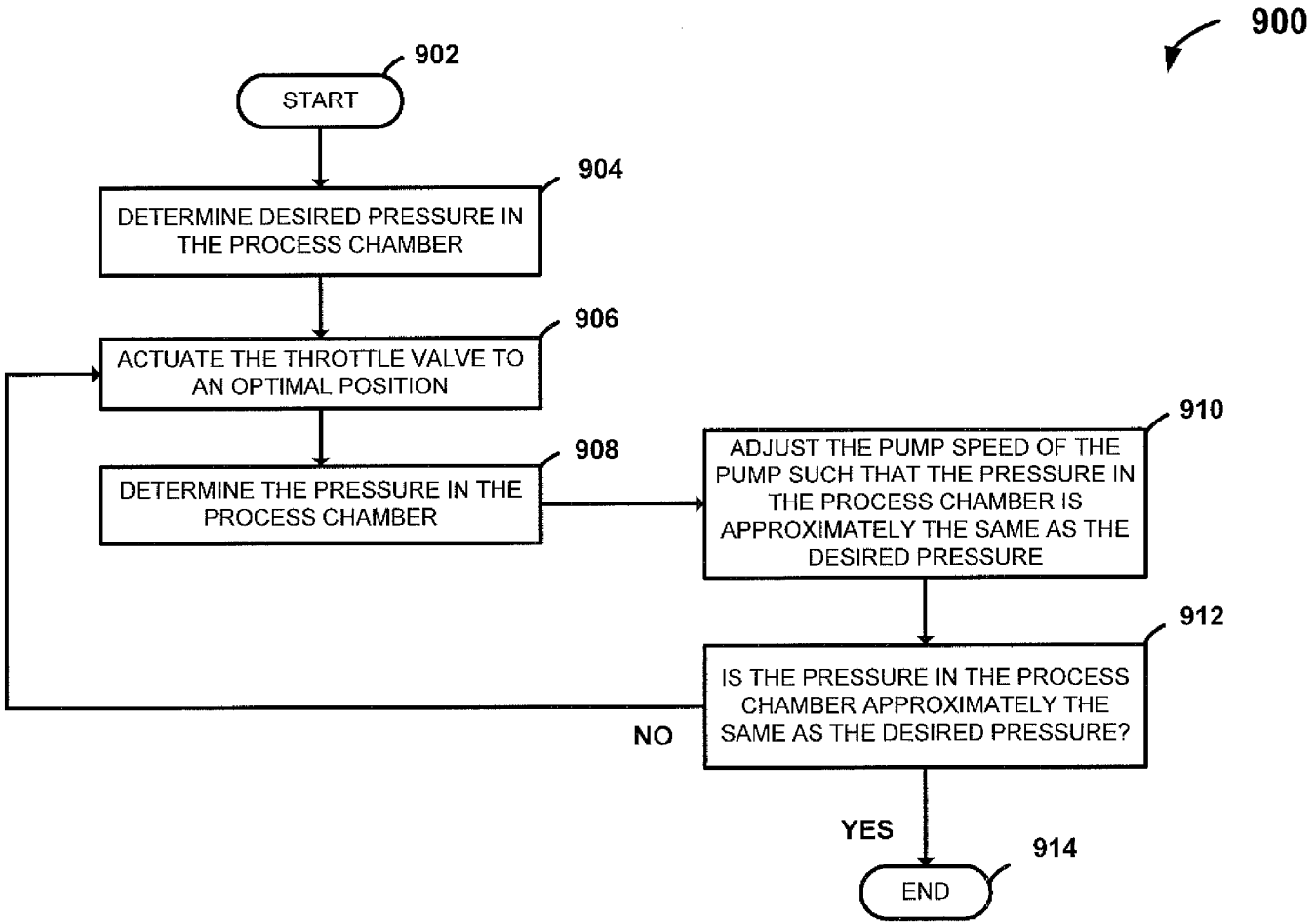
FIG. 9 is a flowchart of a method of modifying at least one parameter in a process chamber by adjusting a parameter of a pump while a throttle valve is in an optimal position in accordance with the present invention.

FIG. 9 is a flowchart of a method of modifying at least one parameter in the process chamber 108 by adjusting a parameter of the pump 104 while a throttle valve 802 is set in an optimal position in accordance with the present invention. Parameters in the process chamber 108 (e.g., pressure, effluent flow, etc.) may be controlled by adjusting at least one parameter of the pump 104.

The method 900 begins with step 902. In step 904, the desired pressure in the process chamber 108 may be determined as discussed above by analyzing acquired measurements or by using a predictive solution based on known functional relationships among the various parameters over time. In step 906, the vane 804 of the throttle valve 802 may be set to an optimal position based on the desired pressure. In one or more embodiments, the optimal position may be an open position. Alternatively, the optimal position may be a partially open position. In step 908, the pressure in the process chamber is determined. In step 910, the pump speed is adjusted such that the pressure in the process chamber approximates the desired pressure. In step 912, the pressure in the process chamber is monitored to determine whether the pressure approximates the desired pressure. If it does, the method ends in step 914; if it does not the method cycles back to step 906 and the vane 804 position is adjusted again (e.g., the position of the vane 804 may be adjusted based on an amount that the actual process chamber pressure differs from the desired pressure).

The foregoing description discloses only exemplary embodiments of the invention. Modifications of the above disclosed apparatus and method which fall within the scope of the invention will be readily apparent to those of ordinary skill in the art. For instance, the methods and apparatus described above may be applied to systems with multiple different configurations including, but not limited to, a single abatement system coupled to multiple process chambers, multiple pumps coupled to a single process chamber, etc.

Accordingly, while the present invention has been disclosed in connection with exemplary embodiments thereof, it should be understood that other embodiments may fall within the spirit and scope of the invention, as defined by the following claims.

The invention claimed is:

1. A method of equilibrating corresponding vacuum line parameters in an electronic device manufacturing system including a pump comprising:

acquiring information related to a parameter of a first vacuum line and information related to a parameter of a second vacuum line, wherein the first and second vacuum lines are fluidically separate;

comparing the information related to the parameter of the first vacuum line with the information related to the parameter of the second vacuum line; and adjusting at least one parameter of the pump such that corresponding parameters of the first and second vacuum lines are equilibrated.

2. The method of claim 1, wherein the information related to the parameter of the first vacuum line includes a length of the first vacuum line, and the information related to the parameter of the second vacuum line includes a length of the second vacuum line.

3. The method of claim 2, wherein the at least one parameter of the pump includes a pump speed.

4. The method of claim 2, wherein the length of the first vacuum line is different from the length of the second vacuum line.

5. The method of claim 4 wherein a pressure differential between the first and second vacuum lines, prior to the step of adjusting at least one parameter of the pump such that corresponding parameters of the first and second vacuum lines are equilibrated, is proportional to the difference in lengths of the first and second vacuum lines, prior to equilibration.

6. The method of claim 1, wherein the information related to the parameter of the first vacuum line includes a cross-sectional shape of the first vacuum line, and the information related to the parameter of the second vacuum line includes a cross-sectional shape of the second vacuum line.

7. The method of claim 6 wherein the cross-sectional shape of the first vacuum line is different from the cross-sectional shape of the second vacuum line.

8. The method of claim 1, wherein the information related to the parameter of the first vacuum line includes a material of the first vacuum line, and the information related to the parameter of the second vacuum line includes a material of the second vacuum line.

9. The method of claim 1, wherein the information related to the parameter of the first vacuum line includes a pressure of an effluent in the first vacuum line, and the information related to the parameter of the second vacuum line includes a pressure of an effluent in the second vacuum line.

10. The method of claim 1, wherein the information related to the parameter of the first vacuum line includes a chemical composition of an effluent in the first vacuum line, and the information related to the parameter of the second vacuum line includes a chemical composition of an effluent in the second vacuum line.

11. The method of claim 1, wherein the information related to the parameter of the first vacuum line includes a viscosity of an effluent in the first vacuum line, and the information related to the parameter of the second vacuum line includes a viscosity of an effluent in the second vacuum line.

12. The method of claim 1, further comprising:

providing sensors adapted to acquire the information related to the parameter of the first vacuum line and the information related to the parameter of the second vacuum line.

* * * * *